United States Patent [19]

Woodle

[11] 4,325,818

[45] Apr. 20, 1982

[54] DUAL SOLVENT REFINING PROCESS

[75] Inventor: Robert A. Woodle, Nederland, Tex.

[73] Assignee: Texaco, Inc., White Plains, N.Y.

[21] Appl. No.: 169,926

[22] Filed: Jul. 17, 1980

[51] Int. Cl.[3] ..... C10G 21/20

[52] U.S. Cl. ..... 208/326

[58] Field of Search ..... 208/323, 326

[56] References Cited

U.S. PATENT DOCUMENTS

| | | | |
|---|---|---|---|
| 3,239,456 | 3/1966 | Woodle et al. | 208/321 |
| 3,249,532 | 5/1966 | Shiah | 208/321 |
| 3,317,423 | 5/1967 | Hebert | 208/327 |
| 3,461,066 | 8/1969 | Morris et al. | 208/321 |
| 3,725,254 | 4/1973 | Wang | 208/314 |
| 4,057,491 | 11/1977 | Bushnell et al. | 208/321 |

*Primary Examiner*—Delbert E. Gantz
*Assistant Examiner*—William Leader
*Attorney, Agent, or Firm*—Carl G. Ries; Robert A. Kulason; George J. Darsa

[57] ABSTRACT

A dual solvent refining process for solvent refining petroleum based lubricating oil stocks with N-methyl-2-pyrrolidone as selective solvent for aromatic oils wherein a highly paraffinic oil having a narrow boiling range approximating the boiling point of N-methyl-2-pyrrolidone is employed as a backwash solvent. The process of the invention results in an increased yield of refined lubricating oil stock of a predetermined quality and simplifies separation of the solvents from the extract and raffinate oil fractions.

5 Claims, 2 Drawing Figures

DUAL SOLVENT REFINING PROCESS

Figure 1:
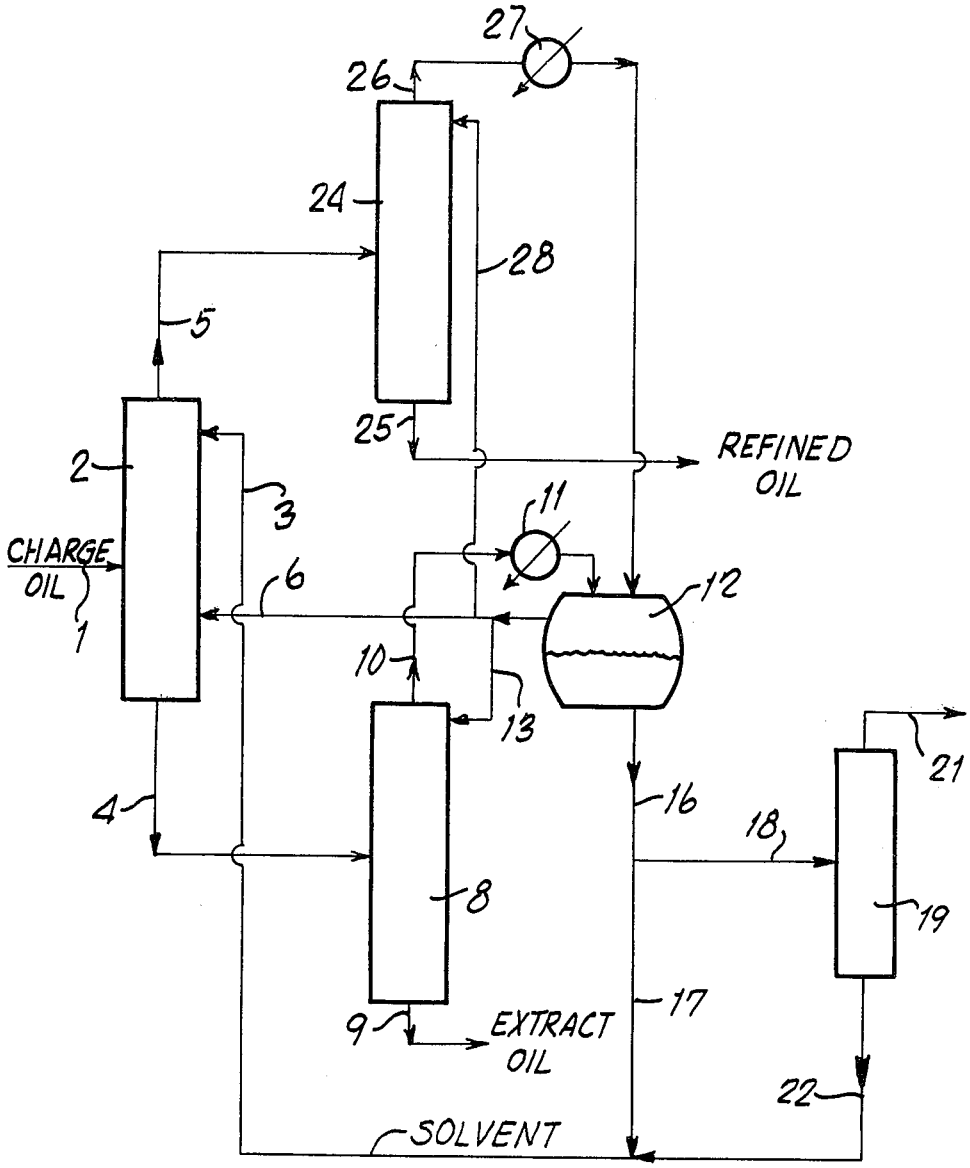

The invention relates to an improved process for the solvent refining of a petroleum based lubricating oil fraction containing aromatic and non-aromatic constituents. In one of its more specific aspects, the invention relates to a method for improving the refined oil yield in a lubricating oil solvent refining process utilizing N-methyl-2-pyrrolidone as a solvent.

It is well known that aromatic and unsaturated hydrocarbons contained in lubricating oil base stocks derived from crude petroleum may be separated from the more saturated hydrocarbon components by various processes involving solvent extraction of the aromatic and unsaturated hydrocarbons. The extraction of unwanted constituents from lubricating oil base stocks with N-methyl-2-pyrrolidone as a solvent has increased significantly in commercial importance in the past several years. Removal of aromatics and other undesirable constituents from lubricating oil base stocks by treatment with N-methyl-2-pyrrolidone improves the viscosity index, color, oxidative stability, thermal stability, and inhibition response of the base oil and of the ultimate lubricating oil products made therefrom.

The advantages of N-methyl-2-pyrrolidone as a lubricating oil extraction solvent for the removal of undesirable aromatic and polar constituents from petroleum based lubricating oil stocks is now well recognized by refiners. Some of these advantages are set forth in U.S. Pat. No. 4,057,491. Prior art processes employing N-methyl-2-pyrrolidone as solvent and illustrating conventional solvent recovery operations are disclosed for example, in U.S. Pat. No. 3,458,431; 3,461,066 and 3,470,089.

In conventional lubricating oil refining with N-methyl-2-pyrrolidone, the solvent extraction step is carried out under conditions effective to recover about 30 to 90 volume percent of the lubricating oil charge as raffinate or refined oil and to extract about 10 to 70 volume percent of the charge as an aromatic extract. The lubricating oil stock is contacted in an extraction zone with solvent at a temperature at least 10° C., preferable at least 50° C., below the temperature of complete miscibility of the lubricating oil stock in the solvent.

In the solvent extraction zone, the lubricating oil feedstock and solvent are contacted with one another in an extraction tower in which the solvent and lubricating oil stock are brought into intimate liquid-liquid contact. The extraction tower may comprise a packed, baffled, or sieve tray tower, with or without mechanical agitation, such as rotating disk or centrifugal contacting devices. Two liquid phases are present in the solvent extraction tower; one is an extract phase containing the major amount of the solvent together with dissolved aromatic components of the charge stock and the other a raffinate phase containing non-aromatic components of the charge stock together with a minor amount of solvent.

Operating conditions are selected to produce a primary raffinate having a dewaxed viscosity index of about 85 to 100, and preferably about 90 to 96. Solvent extraction tower extract outlet temperatures within the range of 40° to 100° C. (about 100° to 212° F.), preferably within the range of 65° to 95° C. (150° to 205° F.), are employed with solvent dosages within the range of 100 to 600 percent, i.e., 100 to 600 volumes of solvent for each 100 volumes of oil feedstock; preferably, solvent dosages are within the range of 150 to 400 percent.

The operation of the extraction tower involves counterflow of the two immiscible liquid phases. Therefore, the mechanical feasibility of the process depends on a significant density difference between the solvent-rich phase, or extract phase, and the oil-rich phase, or raffinate phase. Within the solvent dosage range of 100 to 600 percent, i.e., 100 to 600 volumes of solvent to each 100 volumes of lubricating oil feedstock, the density difference increases with increased solvent dosage. At very low solvent dosages, for example, less than 100 percent, the density difference can become so low as to severely limit the throughput of feed to the solvent extraction tower.

N-methyl-2-pyrrolidone is such an effective solvent for aromatics that in the case of some hydrocarbon charge stocks the solvent dosage needed to produce the desired raffinate quality is impractically low. When operating an extraction tower with dry N-methyl-2-pyrrolidone at the minimum practical dosage, i.e., about 100 percent, and temperature, i.e., about 60° C. (140° F.), the refined oil quality may be higher than desired and the refined oil yield lower than desired.

The process of the invention overcomes the problems mentioned above and permits operation of the extraction step with dry N-methyl-2-pyrrolidone with rapid separation of the two liquid phases within the extraction tower. This and other objects of the invention are accomplished by introducing into the N-methyl-2-pyrrolidone a paraffinic oil having a close boiling range approximating the boiling point of N-methyl-2-pyrrolidone as a solvent modifier.

It has been proposed heretofore to use oil as a backwash solvent and solubility moderator for furfural in solvent extraction to reduce its solubility for the aromatic hydrocarbons as described in U.S. Pat. No. 3,239,456. The present invention provides a process in which dry N-methyl-2-pyrrolidone may be employed in the extraction of highly aromatic feedstocks and at the same time an increased yield of refined oil of given quality, as indicated by its refractive index, obtained. The solvent recovery system is also simplified, with resultant savings in energy requirements of the process as compared with conventional solvent refining processes employing N-methyl-2-pyrrolidone as solvent.

The process of the invention will be more readily understood by reference to the accompanying drawings and the following detailed description of a preferred embodiment of the process.

FIG. 1 of the drawings is a diagramatic flow sheet illustrating the process of this invention.

Figure 2:
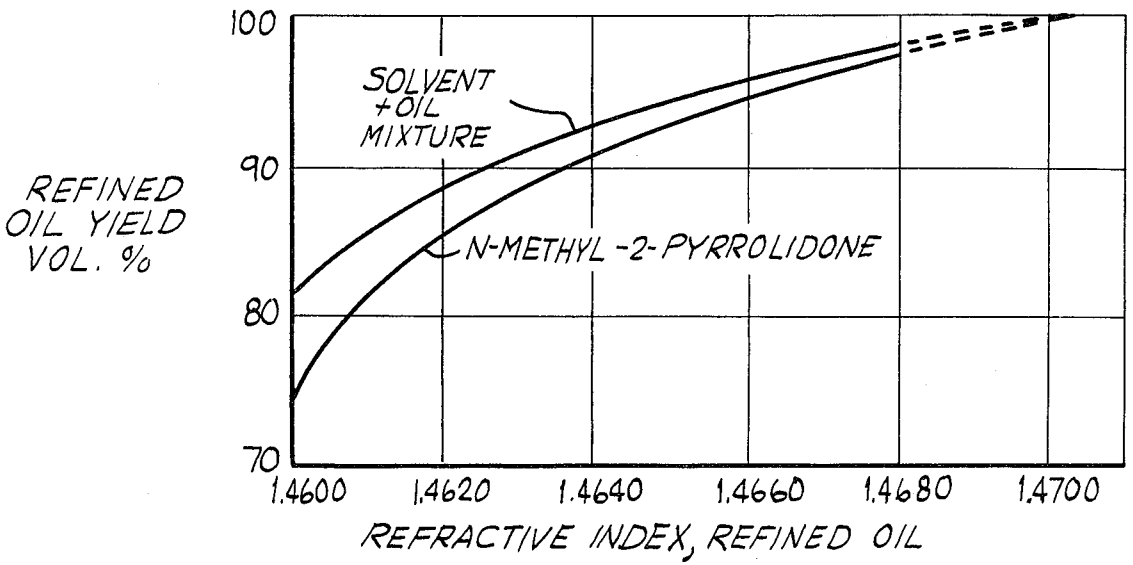

FIG. 2 is a chart diagram illustrating the improvement in refined oil yields which may be obtained by the process of this invention.

With reference to FIG. 1, lubricating oil feedstock is introduced through line 1 into extraction tower 2 wherein the lubricating oil feedstock is countercurrently contacted with N-methyl-2-pyrrolidone introduced into the upper part of extraction tower 2 through line 3. In the extraction tower 2, the lubricating oil feedstock is contacted with dry N-methyl-2-pyrrolidone which has a very high solvent power for aromatic and unsaturated components of the lubricating oil feedstock.

The extraction tower is operated at a temperature in the range of 40° to 100° C. at the extract outlet end of the tower and a temperature in the range of 80° to 120°

C. at the raffinate outlet. Generally, the pressure in the extraction tower is within the range of atmospheric to 100 psig (100 to 800 kPa) and preferably in the range of 20 to 50 psig (240 to 450 kPa).

A solvent-rich phase descends extraction tower 2 forming a primary extract mixture, rich in aromatic and unsaturated components extracted from the feedstock, which is withdrawn from the bottom of extraction tower 2 through line 4. An oil-rich phase rises through extraction tower 2 and is discharged from the upper end of extraction tower 2 through line 5 as a primary raffinate mixture relatively lean in N-methyl-2-pyrrolidone and rich in paraffinic components.

In accordance with this invention, a selected paraffinic backwash oil having a boiling range approximating the boiling point of N-methyl-2-pyrrolidone is introduced into extraction tower 2 through line 6 at a point below the inlet of the lubricating oil feedstock and above the outlet of the primary extract mixture. The amount of paraffinic backwash oil supplied to the extraction tower may be within the range of from about 25 to about 100 volume percent based on the volume of N-methyl-2-pyrrolidone supplied to the extraction tower. In this specific example of a preferred embodiment of the invention, the amount of paraffinic backwash oil supplied to the extraction tower is equivalent to approximately 50 volume percent of the volume of the N-methyl-2-pyrrolidone supplied to the tower. The major portion of the paraffinic backwash oil rises through the extraction tower 2 displacing non-aromatic constituents from the solvent-rich extract phase and is discharged from the top of extraction tower 2 through line 4 as a part of the primary raffinate. A portion of the paraffinic backwash oil dissolves in the solvent-rich extract phase and is withdrawn from the extraction tower with the primary extract mixture through line 4.

The primary extract mixture, containing the major portion of the N-methyl-2-pyrrolidone supplied to extraction tower 2 and containing some of the coboiling paraffinic backwash oil, is passed through line 4 to distillation tower 8. Distillation tower 8 may be a conventional type fractionating column employing bubble cap trays, perforated plates, or packing and means for reboiling the bottoms product as well known in the art. Distillation column 8 suitably is operated at a pressure in the range of 10 to 50 psig (170 to 205 kPa). Extract oil substantially free from solvent and paraffinic backwash oil is discharged from the distillation tower 8 through line 9 as a product of the process.

For the purpose of description of the process of this invention, a single conventional distillation column 8 is described and illustrated in the drawing. It will be understood by those skilled in the art that a more complex separation system may be employed for recovery of the N-methyl-2-pyrrolidone and coboiling paraffinic backwash oil from the solvent. For example, the solvent recovery system may employ a combination of flash towers and vacuum stripping towers as illustrated in U.S. Pat. No. 3,458,431 incorporated herein by reference.

Vaporized N-methyl-2-pyrrolidone and coboiling paraffinic backwash oil are taken overhead from distillation column 8 through line 10 to condenser 11 wherein the vapors are cooled and condensed. Condensate from condenser 11 is collected in condensate accumulator and phase separator 12. Condensate collected in accumulator 12 separates into two phases, an oil-rich phase and a solvent-rich phase. A part of the oil-rich phase is returned to distillation column 8 through line 13 as reflux. The remainder of the oil-rich phase passes through line 6 to the lower part of extraction tower 2 as the paraffinic backwash oil. The paraffinic backwash oil, as well as the solvent, is continuously recirculated and retained in the processing system.

The solvent-rich phase, comprising essentially dry N-methyl-2-pyrrolidone and some dissolved coboiling paraffinic oil, is withdrawn from accumulator 12 through line 16 for reuse in the process. The major portion of the solvent-rich phase passes through line 17 to line 3 for reintroduction into the upper part of extraction column 2.

A part of the solvent-rich phase may be passed through line 18 to distillation tower 19 wherein any extraneous water finding its way into the system, for example, by way of the lubricating oil feedstock supplied to extraction column 2 through line 1 or through leakage of any of the various condensers or heat exchangers, is removed by distillation. Water distilled from the solvent-rich phase in distillation tower 19 is taken overhead through line 21 while dry N-methyl-2-pyrrolidone containing some coboiling paraffinic oil is passed through line 22 to line 3 for recycle to extraction tower 2.

Raffinate is discharged from the top of extraction tower 2 through line 4 to raffinate recovery tower 24 which, like distillation tower 8, may be a conventional distillation tower or may comprise a more complex arrangement of flash towers and strippers as disclosed, for example in U.S. Pat. No. 3,458,431, incorporated herein by reference. Solvent refined oil is discharged from the lower part of distillation tower 24 through line 25 as the principal product of the process. Vaporized N-methyl-2-pyrrolidone and coboiling paraffinic backwash oil, and water, if present, pass overhead from distillation column 24 through line 26 to condenser 27 wherein the vapors are cooled and condensed. Condensate from condenser 27 is collected in condensate accumulator and phase separator 12, where it mixes with condensate from condenser 11 and separates into two phases as already described in connection with distillation column 8. A part of the oil-rich phase is returned to distillation column 24 through line 28 as reflux.

Suitable co-boiling paraffinic backwash oils are highly paraffinic fractions having an atmospheric distillation range in the temperature range of about 375° to 415° F. (190° to 215° C.), preferably about 380° to 410° F. (195° to 210° C.). Such fractions can be readily recovered by distillation from butylene alkylate, or propylene alkylate, or from Udex raffinate.

EXAMPLES

A number of test runs were carried out to demonstrate the process of the present invention. In each of the test runs employing a selective solvent, dry N-methyl-2-pyrrolidone was employed as solvent. The tests were made on a dewaxed, unrefined light paraffin pale oil (180 C Pale Oil) having a refractive index at 70° C. ($RI_{70}$) of 1.4702. Physical properties of the charge oil are shown in Table I.

TABLE I

| LUBRICATION OIL CHARGE STOCK | |
|---|---|
| GRAVITY, °API | 28.2 |
| FLASH (1), COC, °F. | 390 |
| VISCOSITY (2), SUS at 100F | 177 |
| SULFUR, WT. % | 0.16 |

TABLE I-continued

| LUBRICATION OIL CHARGE STOCK | |
|---|---|
| $RI_{70}$(3) | 1.4702 |

(1) Open Cup
(2) Saybolt Universal Seconds
(3) Refractive Index at 70° C.

A narrow boiling range fraction of a highly paraffinic oil was prepared by distilling butylene alkylate to recover a nominal 193°-210° C. (380°-410° F.) boiling range fraction. This boiling range brackets (±9° C. or ±15° F.) the boiling point of N-methyl-2-pyrrolidone (202° C. or 395° F.). Properties of the co-boiling paraffinic backwash oil are listed in Table II.

TABLE II

| CO-BOILING PARAFFINIC BACKWASH OIL | | |
|---|---|---|
| GRAVITY, °API | 53.7 | |
| SPECIFIC GRAVITY | 0.764 | |
| ASTM DISTILLATIONS | °F. | °C. |
| IBP | 377 | 192 |
| 5 | 382 | 194 |
| 10 | 383 | 195 |
| 20 | 384 | 196 |
| 30 | 384 | 196 |
| 40 | 385 | 196 |
| 50 | 386 | 197 |
| 60 | 387 | 197 |
| 70 | 388 | 198 |
| 80 | 389 | 198 |
| 90 | 393 | 201 |
| 95 | 397 | 203 |
| EP | 409 | 209 |

EXAMPLES 1 AND 2

Tests were conducted to determine the effectiveness of the co-boiling paraffinic backwash oil of Table II for displacing paraffinic oil from primary extract mixtures produced by extracting charge oil having the physical properties set forth in Table I with dry N-methyl-2-pyrrolidone. In preparing the primary extract for Example 1, a solvent dosage of 100 volume percent, basis the volume of the charge oil, was employed, while in Example 2, the solvent dosage was 400 volume percent. The amounts of paraffinic oil contained in the primary extract mixture was determined for each of the two process conditions and is shown in Table III. Similarly, the refractive index at 70° C. ($RI_{70}$) after separation of solvent from the extract, was determined for each of the extracts obtained by each of the two process conditions and is reported in Table III.

The extract mixtures were then subjected to a secondary extraction with co-boiling paraffinic backwash oil having the physical properties indicated in Table II. In these tests, equal volumes of solvent-free primary raffinates and co-boiling paraffinic oil were employed with the results shown in Table III.

TABLE III

| EXAMPLE | 1 | 2 |
|---|---|---|
| INITIAL EXTRACTION | | |
| SOLVENT: Dry-N-Methyl-2-Pyrrolidone | | |
| TEMP, °F. (°C.) | 75 (24) | 75 (24) |
| SOLVENT DOSAGE, | | |
| Vol. % Basis Charge | 100 | 400 |
| VOL. % OIL IN EXT. MIX(1) | 7.8 | 4.9 |
| $RI_{70}$ EXTRACT OIL | 1.5335 | 1.5069 |
| SECONDARY EXTRACTION | | |
| CHARGE: Extract Mix From Initial Extraction | | |
| SOLVENT: Coboiling Paraffinic Backwash | | |
| SOLVENT DOSAGE, | | |
| Vol. % Basis Charge | 100 | 100 |
| VOL. % OIL IN SECONDARY RAFFINATE MIX(1) | 4.9 | 3.7 |
| $RI_{70}$ OIL IN SECONDARY RAFFINATE MIX(1) | 1.4978 | 1.4852 |

(1) Paraffinic oil components from the lubricating oil charge stock.

It is evident from the results of Examples 1 and 2 that the co-boiling paraffinic oil has the ability to displace paraffinic oil components of the lubricating oil charge stock from the extract mixture obtained when the charge stock is solvent refined with N-methyl-2-pyrrolidone.

EXAMPLES 3-8

A number of runs were carried out at 24° C. (75° F.) in a single-stage extraction apparatus with various dosages of dry N-methyl-2-pyrrolidone alone as solvent and with mixtures of N-methyl-2-pyrrolidone (MP) and co-boiling paraffinic backwash oil (CBPB) having the physical properties listed in Table II. Results of these test runs are shown in Table IV, wherein operating conditions and results obtained using only N-methyl-2-pyrrolidone as solvent are shown for Examples 3 to 5 and operating conditions and results obtained when employing mixtures of co-boiling paraffinic backwash oil and N-methyl-2-pyrrolidone are shown for Examples 6 to 8.

TABLE IV

EFFECT OF CO-BOILING PARAFFIN BACKWASH (CBPB) ON SINGLE-STAGE REFINING OF LIGHT PARAFFIN PALE OIL WITH N-METHYL-2-PYRROLIDONE (MP) CHARGE OIL: DEWAXED, UNREFINED LIGHT PARAFFIN PALE OIL (180 C PALE OIL); $RI_{70}$ 1.4702

| EXAMPLE | 3 | 4 | 5 | 6 | 7 | 8 |
|---|---|---|---|---|---|---|
| SOLVENT(S) | | | | | | |
| PRIMARY | ←100% MP→ | | | ←MP SATURATED WITH CBPB→ | | |
| BACKWASH | ←NONE→ | | | ←CPBP SATURATED WITH MP→ | | |
| SOLVENT DOSAGE, VOL. % BASIS CHARGE OIL | | | | | | |
| PRIMARY | 100 | 400 | 600 | 228 | 1140 | 1700 |
| BACKWASH | — | — | — | 100 | 100 | 100 |
| $RI_{70}$ | | | | | | |
| EXTRACT OIL | 1.5335 | 1.5069 | 1.4998 | 1.5650 | 1.5230 | 1.5155 |
| REFINED OIL | 1.4643 | 1.4606 | 1.4600 | 1.4655 | 1.4608 | 1.4601 |
| REF. OIL YIELD, VOL. %/CHARGE | 91.5 | 79.3 | 74.4 | 95.3 | 84.9 | 81.8 |

The data from Table IV are shown graphically in FIG. 2 of the drawings wherein the refined oil yield and the refractive index of the refined oil are plotted to show that the process of this invention produces an increased yield of refined oil of any predetermined quality, the yield improvement increasing as the quality of the refined oil increases (as evidenced by a decrease in refractive index).

It will be understood by those skilled in the art that because these tests were carried out in a single contactor rather than in a multi-stage contactor having the equivalent of four or more equilibrium stages as customarily used in commercial solvent refining operations, the solvent dosages employed in these examples are higher than those which would be effective for the same separation in a multi-stage contactor. The advantages of the process of this invention apply equally well multi-stage process conditions and are, in fact, more advantageous in a multi-stage process operation than indicated by the examples.

It will be evident that the process of this invention represents an improved N-methyl-2-pyrrolidone solvent refining process wherein defined oil yields are substantially higher than those obtainable from conventional solvent refining processes employing N-methyl-2-pyrrolidone as solvent. In addition to improving the selectivity of the separation process by reducing the loss of desirable raffinate oil in the extract mix, this process also results in an increase in the specific gravity differential between co-existing liquid phases in the phase separator and thus assists in their spontaneous physical separation. This advantage of the process of this invention is illustrated in the following examples.

EXAMPLES 9 and 10

Tests were conducted at 75° F. on the two phases co-existing under conditions existing in the solvent extraction step. Examination of densities of co-existing phases showed the following comparison:

| EXAMPLE | 9 | 10 |
|---|---|---|
| SOLVENT DOSAGE, VOL % | | |
| BASIS CHARGE | 200 | 200 |
| OIL* DOSAGE, VOL % | | |
| BASIS CHARGE | — | 100 |
| SPECIFIC GRAVITIES | | |
| REFINED OIL MIX | 0.9095 | 0.841 |
| EXTRACT OIL MIX | 1.0200 | 0.998 |
| DIFFERENCE | 0.1105 | 0.157 |

*Co-boiling paraffinic oil of Table II

Thus, when the co-boiling paraffinic oil of Table II was used, the gravity difference between the phases was increased. This larger difference in densities promoted easier phase separation.

It will be evident that the process of this invention consists essentially of a dual-solvent extraction process in which N-methyl-2-pyrrolidone is the primary solvent and a selected paraffinic fraction that substantially co-boils with N-methyl-2-pyrrolidone is a second solvent or "backwash" solvent. The paraffinic backwash oil has the capability of displacing the more paraffinic oil from an extract mix and returning it to the refined oil stream, thus increasing the refined oil yield. By choosing a paraffinic backwash oil that co-boils with N-methyl-2-pyrrolidone, the solvent recovery is simplified since the two solvents can be recovered as one by distillation, and upon condensing and cooling, their mixtures separate into liquid phases comprising a light paraffinic backwash oil-rich phase and a heavy solvent-rich phase, both of which are suitable for recycle directly to the solvent extraction step.

I claim:

1. In a process for solvent refining a petroleum base lubricating oil stock containing aromatic components and paraffinic components effecting separation of said lubricating oil stock into a paraffinic oil raffinate mixture and an aromatics-rich extract mixture wherein said lubricating oil stock is contacted with N-methyl-2-pyrrolidone containing not more than 1 weight percent water in a solvent extraction zone forming a solvent-rich extract phase in said extraction zone containing aromatic components of said oil stock and an oil-rich raffinate phase containing paraffinic components of said oil stock, the improvement which comprises contacting said extract phase in said extraction zone with a co-boiling paraffinic backwash oil containing a minor amount of N-methyl-2-pyrrolidone and having a boiling range of 190° to 210° C. thereby effecting displacement of dissolved non-aromatic hydrocarbons into said raffinate phase, withdrawing resulting raffinate mixture from said extraction zone, distilling said extract and raffinate mixtures effecting separation of product extract and raffinate from N-methyl-2-pyrrolidone solvent and said co-boiling paraffinic oil by vaporization of said solvent and co-boiling oil, cooling and condensing vapors of co-boiling paraffinic oil and N-methyl-2-pyrrolidone and forming a condensate separating into two liquid phases comprising a solvent-rich phase containing dissolved co-boiling paraffinic oil and a co-boiling paraffinic oil-rich phase containing dissolved solvent, passing said solvent-rich phase to said extraction zone as said solvent therefore, and passing said co-boiling paraffinic oil containing N-methyl-2-pyrrolidone to said extraction zone into contact with said extract phase therein as said paraffinic backwash oil, recovering resulting extract mixture from said extraction zone, and recovering said product raffinate from said distillation zone.

2. A process according to claim 1 wherein said N-methyl-2-pyrrolidone supplied to said extraction zone contains 0 to 1.0 weight percent water.

3. A process according to claim 1 wherein the amount of N-methyl-2-pyrrolidone supplied to said extraction zone is within the range of 100 to 600 volume percent basis the volume of said lubricating oil feedstock.

4. A process according to claim 3 wherein the amount of N-methyl-2-pyrrolidone supplied to said extraction zone is within the range of 150 to 400 volume percent.

5. A process according to claim 3 wherein the amount of said co-boiling paraffinic oil supplied to said extraction zone is within the range of 25 to 50 volume percent basis the volume of solvent supplied to said extraction zone.

* * * * *